US005775877A

United States Patent [19]

Genz

[11] Patent Number: 5,775,877

[45] Date of Patent: Jul. 7, 1998

[54] SUBMERSIBLE MOTOR-DRIVEN PUMP WITH FLOAT SWITCH

[75] Inventor: Otto Genz, Overath, Germany

[73] Assignee: ABS Pumps, Ltd., Wexford, Ireland

[21] Appl. No.: 607,004

[22] Filed: Feb. 26, 1996

[30] Foreign Application Priority Data

Feb. 28, 1995 [DE] Germany ..... 195 07 010.0

[51] Int. Cl.[6] ..... F04B 49/04; F04B 49/00

[52] U.S. Cl. ..... 417/41; 417/40; 73/306; 200/84 C

[58] Field of Search ..... 417/40, 41; 73/306; 200/84 C, 84 R, 82 C

[56] References Cited

U.S. PATENT DOCUMENTS

| | | | |
|---|---|---|---|
| 3,897,172 | 7/1975 | Hall | 417/40 |
| 4,021,144 | 5/1977 | Matsusaka | 417/40 |
| 4,084,073 | 4/1978 | Keener | 417/40 |
| 4,345,879 | 8/1982 | Steiner | 417/40 |
| 4,441,860 | 4/1984 | Tsujimoto | 417/40 |
| 4,540,342 | 9/1985 | Steiner et al. | 417/40 |
| 4,626,175 | 12/1986 | Riback et al. | 417/40 |
| 4,961,018 | 10/1990 | Akhter | 310/87 |
| 5,007,450 | 4/1991 | Babb et al. | 417/40 |
| 5,055,000 | 10/1991 | Akhter | 417/40 |
| 5,100,343 | 3/1992 | Peterson | 417/40 |
| 5,155,311 | 10/1992 | Utke . | |

FOREIGN PATENT DOCUMENTS

| | | | |
|---|---|---|---|
| 1002148 | 12/1976 | Canada | 417/40 |
| 1198933 | 1/1986 | Canada | 417/40 |
| 1139998 | 4/1958 | Germany . | |
| 3332050 | 9/1983 | Germany . | |
| 85221805 | 7/1985 | Germany . | |

*Primary Examiner*—Timothy Thorpe
*Assistant Examiner*—Xuan M. Thai
*Attorney, Agent, or Firm*—Diller, Ramik & Wight, PC

[57] ABSTRACT

An electric submersible motor-driven pump includes a pump housing (2) in which is located a pump motor (3) and an associated impeller (4). A separate detachable float and switch housing (6) is detachably connected to the pump housing (2) and defines a substantially elongated upright chamber having a longitudinal axis in which an elongated float (8) moves for operating a switch arm of a switch whose electrical components are isolated from the fluid being pumped. A switchable adapter plug exteriorly of the housings is rendered operative by the electrical components upon movement of the float (8) to selectively energize or de-energize the pump motor (3).

3 Claims, 2 Drawing Sheets

SUBMERSIBLE MOTOR-DRIVEN PUMP WITH FLOAT SWITCH

BACKGROUND OF THE INVENTION

The invention relates to an electric submersible motor-driven pump which can be switched on and off by means of a liquid level-dependent float switch, said float switch consisting of a float which is arranged in movable fashion in the direction of buoyancy in a housing open to the liquid and which interacts with a liquid-tight encapsulated switch for switching the pump motor on and off.

A submersible motor-driven pump of this kind is familiar from DE-PS 33 32 050, for example. In this submersible motor-driven pump, the float can be accommodated in a chamber attached to, or integrated in, the housing, while the switch for switching the pump on and off is located in the upper section of the pump housing. The switch operated by the float acts directly on the power supply of the pump motor, interrupting it when the float reaches its lower position.

Pumps of this kind are used, for example, for draining gully holes, the pump being switched off automatically when the water level in the gully hole drops below a certain point. These pumps can also be used for delivering a certain quantity of liquid, independently of the liquid level, if they are switched on or off by additional devices, independently of the position of the float, although a pump of this kind is essentially unsuitable for applications of this kind. It is also relatively expensive as a result of the integrated switch or float.

In addition, float switches for switching submersible motor-driven pumps on and off automatically have also become known which consist of a switch located in a float, mounted in movable fashion on the pump housing by means of a flexible cable, which transmits a control pulse to a switchable adapter plug, located between the pump motor and the power mains, as a function of its position in the liquid. However, in the case of pumps of this kind, there must always be sufficient space in the shaft or sump for the float to move freely.

As soon as the free movement of the float is obstructed by shaft walls or floating objects, it can no longer be guaranteed that the pump is switched off or on automatically.

Additionally, the cable containing the electrical leads is at risk of fracturing in the long term as a result of the alternating bending stress, meaning that problems can arise with these float switches after a certain period of use.

In the case of the pumps with integrated switches, described first and reflecting the prior art, there is furthermore a problem if the pump breaks down and the cause of the fault is to be determined. The problem lies in the fact that it is impossible to establish directly whether there is a fault in the pump control, in the form of the switch, or whether the pump drive motor is faulty. The pump housing has to be opened in order to establish the cause and, in the case of many modern pump designs, this should be avoided if at all possible for safety reasons, because tightness problems and, consequently, insulation problems can occur after reassembling the pump housing. For this reason, the housings used often cannot be opened, at least not by a layman.

SUMMARY OF THE INVENTION

The invention is based on the task of creating an electric submersible motor-driven pump which is inexpensive and offers improved functional characteristics.

In accordance with the invention, this task is solved in that the float and the switch are accommodated in a separate component that can be fastened to the housing of the submersible motor-driven pump in detachable fashion, the switch interacting with a switchable adapter plug located outside the medium being pumped, between a power source and the pump motor.

Thus, in the submersible motor-driven pump in accordance with the invention, the controller which, in the form of the liquid-tight encapsulated switch, interacts with the float, is housed in a separate component which can be retrofitted to the pump, if this is practical for the desired application. The pump can thus be manufactured inexpensively without this retrofit unit and used for the vast majority of applications.

If, however, the pump is subsequently to be converted for automatic operation, this simply requires fastening the separate component containing the float and the switch to the pump housing in detachable fashion. In this context, the control pulse of the switch is connected to a switchable adapter plug, located between the power source and the pump motor. This permits very simple checking of the pump function, since removing the adapter plug and the separate component makes it very easy to establish whether the electric motor of the submersible pump is faulty or whether there is a fault in the control section.

The movable arrangement of the float in the housing open to the liquid, where there may be slits for the liquid in the lower region, for example, simultaneously guarantees that the float can move without hindrance in the direction of buoyancy, meaning that there is no need to pay attention to the freedom of movement of the float, as this is always ensured with the device in accordance with the invention.

In order to guarantee reliable activation of the pump when the liquid level rises, the float preferably displays different cross-sections over its length in the direction of buoyancy. As a result, the buoyancy force of a rising liquid level does not act proportionally on the float; instead, the buoyancy is increased more than proportionally by the areas with a wider cross-section, meaning that sufficiently high buoyancy forces exist with relatively short switching paths.

The float is preferably designed as a one-piece plastic body and can consist of a lower float element, widening at right angles to the direction of buoyancy, a long section leading upwards from there, and an upper float element, widening at right angles to the direction of buoyancy, at a certain distance from the lower float element. As a result, the float is caused to rise when the liquid level reaches the upper widened area, at the latest.

The switch located in the separate component in liquid-tight fashion is preferably designed as a microswitch with a switching lever which is forced up by the rising float, thus causing the power supply to be enabled via the switchable adapter plug.

In order to ensure easy and simplified mounting of the separate component, this can expediently be slipped onto guide rails of the pump housing, or it can be fixed in detachable fashion at a defined position on the guide housing, for instance with the aid of snap-on elements.

An example of the invention is illustrated in the drawings and explained in detail below on the basis of the drawings. The drawings show the following:

DESCRIPTION OF THE PREFERRED EMBODIMENTS

Figure 1:
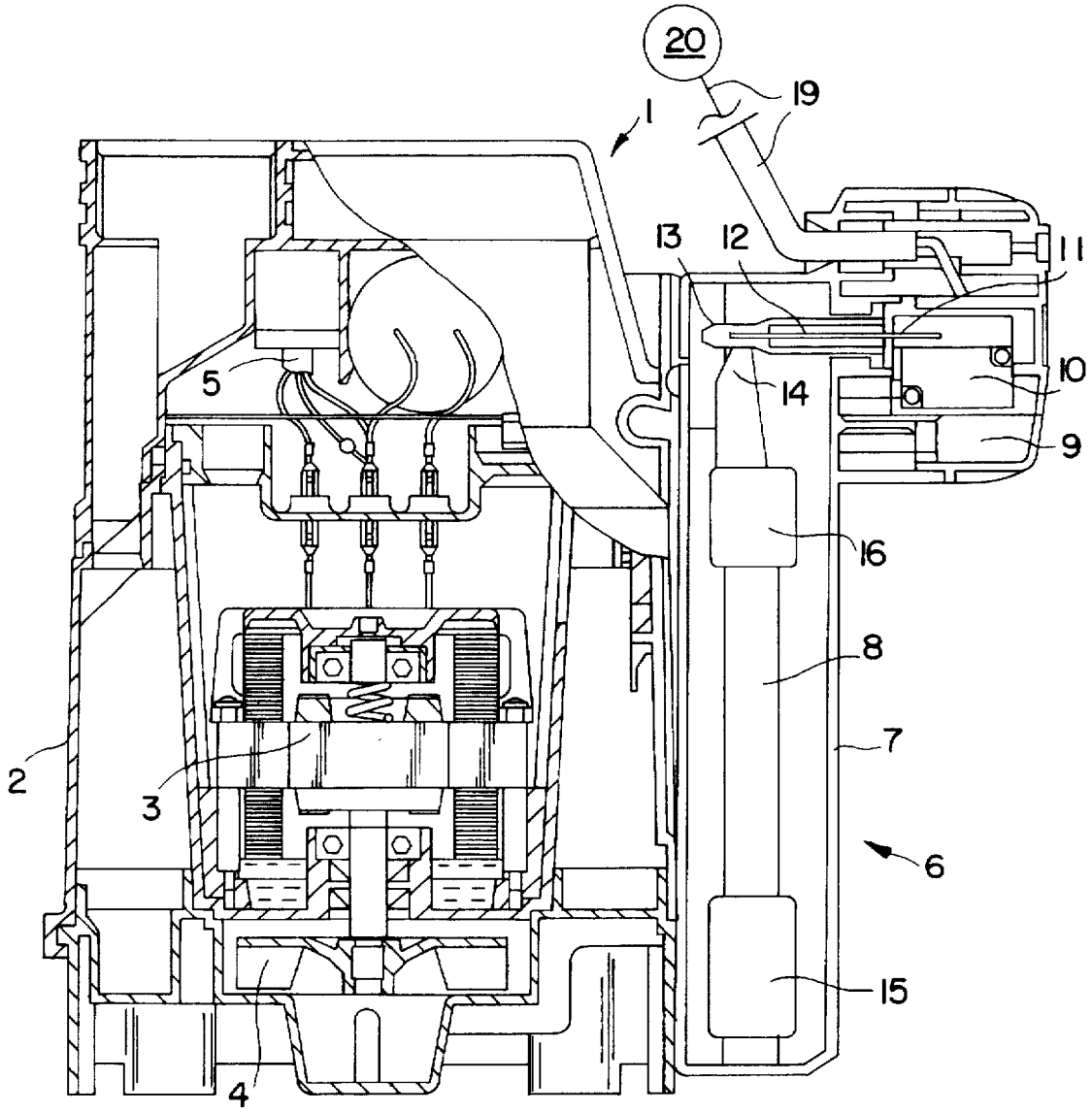
FIG. 1 a lateral section through an electric submersible motor-driven pump with attached separate component housing a float and a liquid-tight switch.
Figure 2:
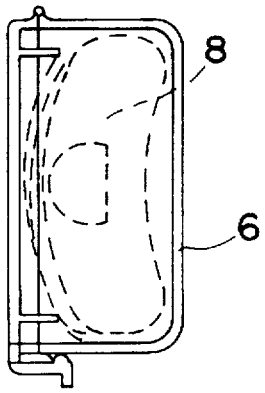
FIG. 2 a section through the middle section of the separate component.

FIG. 1 illustrates an electric submersible motor-driven pump 1, where an electric motor 3 is located inside a housing 2 to drive an impeller 4, with the aid of which liquids can be conveyed. The power to the electric motor 3 is supplied via a cable lead 5, which can be connected to a power source (not shown).

Mounted on the housing 2 of the submersible motor-driven pump 1 in detachable form is a separate component 6, consisting of a long housing section 7, open to the liquid, for accommodating a float 8 and a liquid-tight encapsulated head section 9 for accommodating a switching unit 10.

The switching unit 10 comprises a microswitch 11, which is actuated by means of a switching lever 12.

The switching lever 12 is located inside a rubber cuff 13 or a plastic hose in order to seal it.

The upper, tapered end 14 of the float 8 lies against the switching lever 12, meaning that the switching unit 10 is actuated by the movement of the float 8 in or against the direction of buoyancy.

The float 8 consists of a widened lower float element 15 and a similarly widened upper float element 16, arranged at a distance from the lower float element 15.

Figure 3:
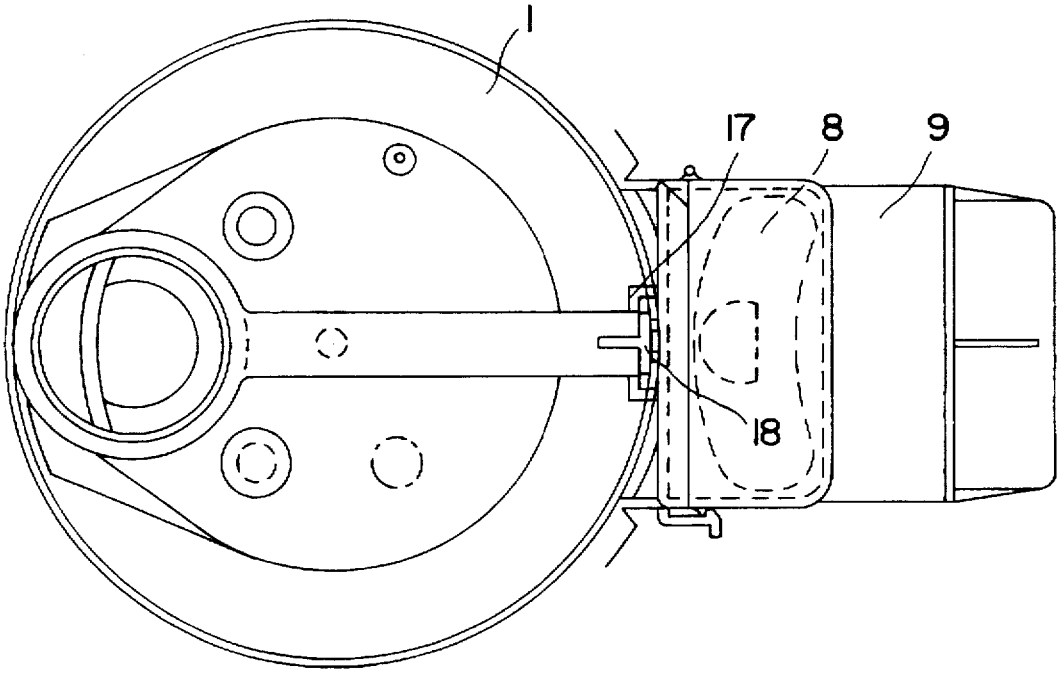
FIG. 3 a section through the upper section of the submersible motor-driven pump and the separate component as per FIG. 1.

The separate component 6 (see FIG. 3) can be slid onto a guide rail 18 of the housing 1 with the aid of a claw 17 and locked in a specific position.

A liquid-tight cable 19 leads out of the head section 9 of the separate component 6 and is connected to a switchable adapter plug (20) which is located between the power source and the electric motor 3 of the submersible motor-driven pump.

When the float 8 moves downwards as a result of gravity when the liquid level is correspondingly low, the switching unit is actuated via the switching lever 12 in such a way that the switchable adapter plug (not shown) interrupts the power supply to the electric motor 3, this causing the pump to be switched off. The switching operation for enabling the power supply takes place accordingly when the liquid level rises.

Although a preferred embodiment of the invention has been specifically illustrated and described herein, it is to be understood that minor variations may be made in the apparatus without departing from the spirit and scope of the invention, as defined the appended claims.

I claim:

1. An electric submersible motor-driven pump comprising a pump housing (2), a pump motor (3) and an associated impeller (4) disposed within said pump housing (2), a separate detachable float and switch housing (6), means for detachably securing said float and switch housing (6) relative to said pump housing (2), means for placing said housings in fluid communication with each other, said float and switch housing (6) defining a substantially elongated upright chamber having a substantially longitudinal axis, an elongated float (8) mounted for movement in said elongated upright chamber along said substantially longitudinal axis, a switch (10) in said float and switch housing (6) operative by movement of said float (8), means for isolating electrical components of said switch from fluid in said float and switch housing (6), a switchable adapter plug (20) exterior of said housings rendered operative by said electrical components upon movement of said float (8) to selectively energize or de-energize said pump motor (3), said elongated float (8) being a one-piece hollow body defined by upper (16) and lower (15) relatively wide hollow float portions and an elongated narrow medial hollow float portion therebetween, said isolating means being a fluid tight chamber portion (9) of said elongated float and switch housing (6), said electrical components being housed in said fluid tight chamber portion (9), and a switch arm (12) of said switch (10) being rendered operative by movement of said elongated float (8).

2. The electric submersible motor-driven pump as defined in claim 1 wherein said detachable securing means is a male and female snap connection between said housings.

3. The electric submersible motor-driven pump as defined in claim 1 wherein said detachable securing means is a slidable connection between said housings.

* * * * *